US005941224A

United States Patent [19]

Miyashita et al.

[11] Patent Number: 5,941,224

[45] Date of Patent: Aug. 24, 1999

[54] AIR-FUEL RATIO CONTROL SYSTEM FOR INTERNAL COMBUSTION ENGINES

[75] Inventors: Kotaro Miyashita; Hirofumi Mutoh; Yuichiro Tanabe, all of Wako, Japan

[73] Assignee: Honda Giken Kogyo Kabushiki Kaisha, Tokyo, Japan

[21] Appl. No.: 08/902,274

[22] Filed: Jul. 29, 1997

[30] Foreign Application Priority Data

Aug. 8, 1996 [JP] Japan ..... 8-224608

[51] Int. Cl.[6] ..... F02D 41/14; F02M 25/08

[52] U.S. Cl. ..... 123/698

[58] Field of Search ..... 123/674, 698, 123/520

[56] References Cited

U.S. PATENT DOCUMENTS

| | | | |
|---|---|---|---|
| 5,209,214 | 5/1993 | Ikuta et al. | 123/698 |
| 5,404,862 | 4/1995 | Ohta et al. | 123/698 |
| 5,613,481 | 3/1997 | Kitagawa et al. | 123/698 |
| 5,632,261 | 5/1997 | Maki et al. | 123/698 |
| 5,699,778 | 12/1997 | Muraguchi et al. | 123/698 |

FOREIGN PATENT DOCUMENTS 4-231636 8/1992 Japan .

*Primary Examiner*—Willis R. Wolfe

*Attorney, Agent, or Firm*—Nikaido, Marmelstein, Murray & Oram LLP

[57] ABSTRACT

An air-fuel ratio control system for an internal combustion engine includes an air-fuel ratio sensor arranged in the exhaust system of the engine, for generating an output indicative of the air-fuel ratio of exhaust gases emitted from the engine. An ECU carries out feedback control of controlling the air-fuel ratio of a mixture supplied to the engine to a predetermined desired air-fuel ratio in response to the output from the air-fuel ratio sensor, by using at least one feedback control gain. A purge control valve purges evaporative fuel generated in the fuel tank to the engine. The at least one feedback control gain is set to a smaller value when the degree of influence of evaporative fuel purged by the purge control valve upon the air-fuel ratio of the mixture is larger, and set to a larger value when the degree of influence of the purged evaporative fuel upon the air-fuel ratio of the mixture is smaller.

7 Claims, 8 Drawing Sheets

| KCMD | KEVAP | |
|---|---|---|
| | LARGE | SMALL |
| STOICHIOMETRIC A/F RATIO $\lambda=1$ | F/B CONTROL GAIN LARGE | F/B CONTROL GAIN SMALL |
| VALUE OTHER THAN STOICHIOMETRIC A/F RATIO LEAN OR WOT(RICH) | F/B CONTROL GAIN MEDIUM | F/B CONTROL GAIN SMALL |

*FIG.3*

| KCMD | KEVAP | |
|---|---|---|
| | LARGE | SMALL |
| STOICHIOMETRIC A/F RATIO $\lambda = 1$ | F/B CONTROL GAIN LARGE | F/B CONTROL GAIN SMALL |
| VALUE OTHER THAN STOICHIOMETRIC A/F RATIO LEAN OR WOT(RICH) | F/B CONTROL GAIN MEDIUM | F/B CONTROL GAIN SMALL |

AIR-FUEL RATIO CONTROL SYSTEM FOR INTERNAL COMBUSTION ENGINES

BACKGROUND OF THE INVENTION

1. Field of the Invention

This invention relates to an air-fuel ratio control system for internal combustion engines, and more particularly to an air-fuel ratio control system of this kind, which feedback-controls the air-fuel ratio of a mixture supplied to the engine to a desired air-fuel ratio, by using an exhaust gas component concentration sensor which has an output characteristic almost proportional to the concentration of a specific component in exhaust gases emitted from the engine.

2. Prior Art

There is conventionally known an air-fuel ratio control system for internal combustion engines, which controls the air-fuel ratio of a mixture supplied to the engine to an air-fuel ratio set in dependence on operating conditions of the engine, by using an exhaust gas component concentration sensor which has an output characteristic almost proportional to the concentration of a specific component in exhaust gases emitted from the engine, and changes the feedback gain according to the set air-fuel ratio (e.g. Japanese Laid-Open Patent Publication (Kokai) No. 4-231636). According to the known control system, when the set air-fuel ratio is a stoichiometric air-fuel ratio, the feedback gain is set to a relatively large value to obtain the maximum purification efficiency of a catalyst arranged in the exhaust system, for purifying noxious components in exhaust gases, while when the set air-fuel ratio is a leaner air-fuel ratio or a richer air-fuel ratio than the stoichiometric air-fuel ratio, the feedback gain is set to a relatively small value.

In the known air-fuel ratio control system, however, the feedback gain is thus set to a relatively large value during execution of the feedback control for controlling the air-fuel ratio to the stoichiometric value. As a result, when a disturbance occurs during execution of the feedback control due to the influence of purging of evaporative fuel generated in the fuel tank, or other factors, the air-fuel ratio of the mixture supplied to the engine can diverge.

SUMMARY OF THE INVENTION

It is the object of the invention to provide an air-fuel ratio control system for internal combustion engines, which is capable of performing air-fuel ratio feedback control in a stable manner even when a disturbance such as purging of evaporative fuel occurs.

To attain the above object, the present invention provides an air-fuel ratio control system for an internal combustion engine having an exhaust system and a fuel tank, including air-fuel ratio-detecting means arranged in the exhaust system, for generating an output indicative of an air-fuel ratio of exhaust gases emitted from the engine, feedback control means for carrying out feedback control of controlling an air-fuel ratio of a mixture supplied to the engine to a predetermined desired air-fuel ratio in response to the output from the air-fuel ratio-detecting means, by using at least one feedback control gain, and purge control means for purging evaporative fuel generated in the fuel tank to the engine.

The air-fuel ratio control system is characterized by an improvement wherein:

The feedback control means sets the at least one feedback control gain to a smaller value when a degree of influence of evaporative fuel purged by the purge control means upon the air-fuel ratio of the mixture is larger, and sets the at least one feedback control gain to a larger value when the degree of influence of the purged evaporative fuel upon the air-fuel ratio of the mixture is smaller.

Preferably, the feedback control means sets the at least one feedback control gain in dependence on the predetermined desired air-fuel ratio and the degree of influence of the purged evaporative fuel upon the air-fuel ratio of the mixture.

More preferably, the feedback control means sets the at least one feedback control gain to a smaller value when the predetermined desired air-fuel ratio is equal to a stoichiometric air-fuel ratio and at the same time the degree of influence of the purged evaporative fuel upon the air-fuel ratio of the mixture is larger.

Preferably, the feedback control means calculates an air-fuel ratio correction value based on a difference between the output from the air-fuel ratio-detecting means and the predetermined desired air-fuel ratio and the at least one feedback control gain, and corrects a feedback control amount for use in the feedback control by using the air-fuel ratio correction value.

More preferably, the feedback control means sets an evaporative fuel-dependent correction value in dependence on the degree of influence of the purged evaporative fuel upon the air-fuel ratio of the mixture, and corrects the feedback control amount by using the evaporative fuel-dependent correction value together with the air-fuel ratio correction value.

Further preferably, the feedback control means calculates the evaporative fuel-dependent correction value, based on the air-fuel ratio correction value.

Advantageously, the air-fuel ratio-detecting means has an output characteristic almost proportional to the air-fuel ratio of the exhaust gases.

The above and other objects, features, and advantages of the invention will be more apparent from the following detailed description taken in conjunction with the accompanying drawings.

BRIEF DESCRIPTION OF THE DRAWINGS

FIG. 3 shows a table for setting a feedback control gain of air-fuel ratio control according to operating conditions of the engine and an evaporative fuel-dependent correction coefficient KEVAP;

DETAILED DESCRIPTION

The invention will now be described in detail with reference to the drawings showing an embodiment thereof.

Figure 1:
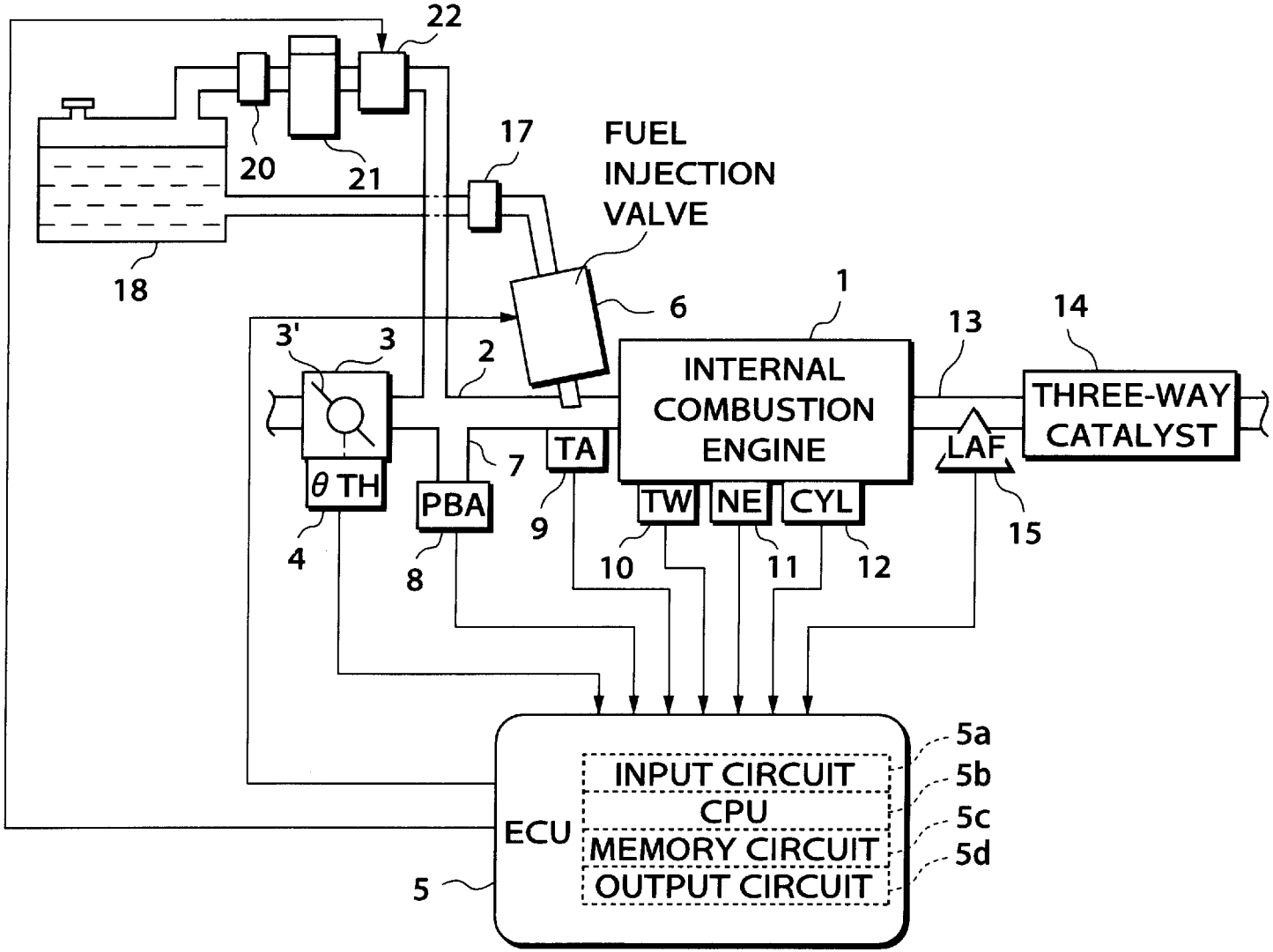
FIG. 1 is a block diagram schematically showing the arrangement of an internal combustion engine and an air-fuel ratio control system therefor, according to an embodiment of the invention.

Referring first to FIG. 1, there is illustrated the arrangement of an internal combustion engine and an air-fuel ratio control system therefor, according to an embodiment of the invention.

In the figure, reference numeral 1 designates an internal combustion engine (hereinafter simply referred to as "the engine"), which has an intake pipe 2 connected to the cylinder block of the engine 1. Arranged across the intake pipe 2 is a throttle body 3 accommodating a throttle valve 3' therein. A throttle valve opening (θTH) sensor 4 is connected to the throttle valve 3', for generating an electric signal indicative of the sensed throttle valve opening θTH to an electronic control unit (hereinafter referred to as "the ECU") 5.

Fuel injection valves 6, only one of which is shown, are each provided for each cylinder and arranged in the intake pipe 2 at a location intermediate between the engine 1 and the throttle valve 3' and slightly upstream of an intake valve, not shown. The fuel injection valves 6 are connected via a fuel pump 17 to a fuel tank 18, and electrically connected to the ECU 5 to have their valve opening periods controlled by signals therefrom.

On the other hand, an intake pipe absolute pressure (PBA) sensor 8 is connected via a conduit 7 to the intake pipe 2 at a location immediately downstream of the throttle valve 3', for sensing absolute pressure PBA within the intake pipe 2, and is electrically connected to the ECU 5, for supplying an electric signal indicative of the sensed absolute pressure PBA to the ECU 5. Further, an intake air temperature (TA) sensor 9 is inserted into the intake pipe 2 at a location downstream of the PBA sensor 8, for supplying an electric signal indicative of the sensed intake air temperature TA to the ECU 5.

An engine coolant temperature (TW) sensor 10, which may be formed of a thermistor or the like, is mounted in the cylinder block of the engine 1, for supplying an electric signal indicative of the sensed engine coolant temperature TW to the ECU 5.

An engine rotational speed (NE) sensor 11 and a cylinder-discriminating (CYL) sensor 12 are arranged in facing relation to a camshaft or a crankshaft of the engine 1, neither of which is shown. The NE sensor 11 generates a signal pulse (hereinafter referred to as "a TDC signal pulse") at each of predetermined crank angles whenever the crankshaft rotates through 180 degrees, while the CYL sensor 12 generates a signal pulse at a predetermined crank angle of a particular cylinder of the engine, both of the pulses being supplied to the ECU 5.

A three-way catalyst 14 is arranged in an exhaust pipe 13 of the engine 1, for purifying noxious components, such as HC, CO, NOx, which are present in exhaust gases emitted from the engine. An oxygen concentration sensor (hereinafter referred to as "the LAF sensor") 15 as air-fuel ratio-detecting means is arranged in the exhaust pipe 13 at a location upstream of the three-way catalyst 14, for generating an electric signal as an actual air-fuel ratio KACT, which is almost proportional in value to the concentration of oxygen present in exhaust gases from the engine 1, and supplying the same to the ECU 5.

Arranged between the fuel tank 18 and a portion of the intake pipe 2 immediately downstream of the throttle valve 3' is an evaporative emission control system which is comprised of a two-way valve 20, a canister 21, and a purge control valve 22. The purge control valve 22 is electrically connected to the ECU 5 to have its operation controlled by a control signal therefrom. More specifically, evaporative fuel generated in the fuel tank 18 increases in pressure within the fuel tank 18, and when the pressure within the fuel tank 18 reaches a predetermined value, a positive pressure valve, not shown, of the two-way valve 20 is forced to open by the increased pressure to permit evaporative fuel to flow into the canister 21 for temporary storage therein. When the purge control valve 22 is opened in response to the control signal from the ECU 5, evaporative fuel stored in the canister 21 is drawn into the intake pipe 2 together with fresh air introduced into the canister 21 via an air inlet port, not shown, provided therein by a drawing force of vacuum created within the intake pipe 2, and supplied to the cylinders. When the fuel tank 18 is cooled, e.g. by a cold ambient air so that negative pressure increases within the fuel tank 18, a negative pressure valve, not shown, of the two-way valve 20 is opened to return evaporative fuel stored in the canister 21 to the fuel tank 18. The evaporative emission control system thus operates to prevent evaporative fuel generated in the fuel tank 18 from being emitted into the atmosphere.

The ECU 5 is comprised of an input circuit 5*a* having the functions of shaping the waveforms of input signals from various sensors, shifting the voltage levels of sensor output signals to a predetermined level, converting analog signals from analog-output sensors to digital signals, and so fourth, a central processing unit (hereinafter referred to as "the CPU") 5*b*, a memory circuit 5*c* storing various operational programs which are executed by the CPU 5*b* and for storing results of calculations therefrom, etc., and an output circuit 5*d* which delivers driving signals to the fuel injection valves 6, the purge control value 22, etc.

The CPU 5*b* operates in response to the above-mentioned signals from the sensors to determine operating conditions in which the engine 1 is operating, such as an air-fuel ratio feedback control region in which air-fuel ratio control is carried out in response to the oxygen concentration in exhaust gases, and open-loop control regions, and calculates, based upon the determined engine operating conditions, a valve opening period or fuel injection period Tout over which the fuel injection valves are to be opened in synchronism with generation of TDC signal pulses, by the use of the following equation (1):

$$Tout = Ti \times KCMD \times KLAF \times KEVAP \times K1 + K2 \quad (1)$$

where Ti represents a basic value of the fuel injection period Tout, which is determined in accordance with the engine rotational speed NE and the intake pipe absolute pressure PBA. A Ti map, not shown, for use in determining the Ti value is stored in the memory circuit 5*c*.

KCMD represents a desired air-fuel ratio coefficient calculated according to operating conditions of the engine. As is apparent from the above equation (1), the fuel injection period Tout is increased as the desired air-fuel ratio coefficient KCMD increases, and accordingly the KCMD value is proportional to the reciprocal of the air-fuel ratio A/F of a mixture to be supplied to the engine.

KLAF represents an air-fuel ratio correction coefficient, which is calculated by a routine of FIG. 2, described hereinafter, such that the actual air-fuel ratio KACT detected by the LAF sensor 15 becomes equal to the desired air-fuel ratio (i.e. coefficient KCMD) during execution of air-fuel ratio feedback control, while it is set to predetermined values depending upon respective operating regions of the engine during execution of open-loop control.

Figure 4:
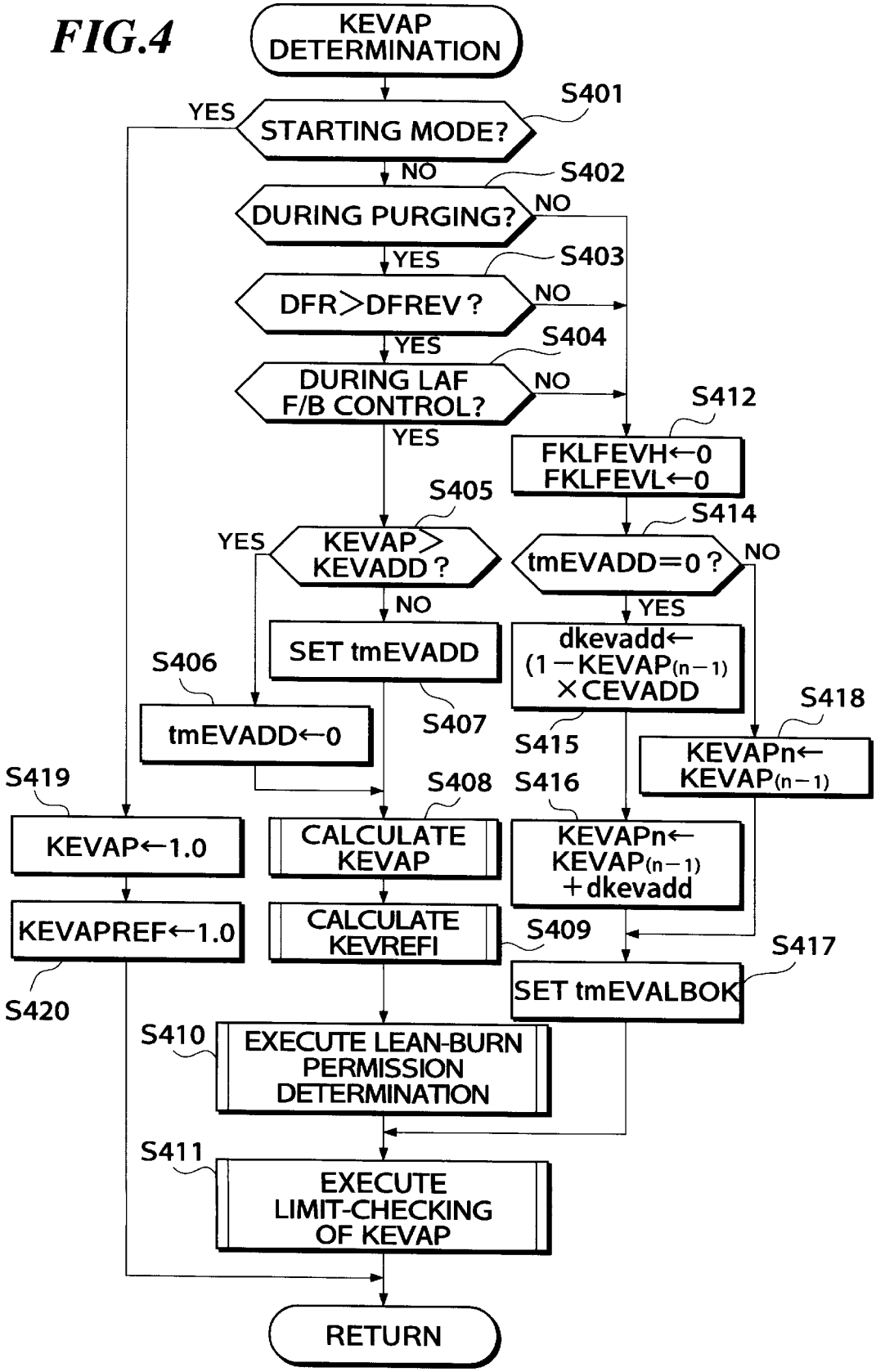
FIG. 4 is a flowchart showing a routine for determining the evaporative fuel-dependent correction coefficient KEVAP.

KEVAP represents an evaporative fuel-dependent correction coefficient for compensating for the influence of purged evaporative fuel, which is determined by a subroutine of FIG. 4. The KEVAP value is set to 1.0 when purging is not effected, while it is set to a value between 0 and 1.0 during execution of purging. A smaller value of the coefficient KEVAP means a larger degree of influence of purging.

K1 and K2 represent other correction coefficients and correction variables, respectively, which are set according to operating parameters to such values as optimize operating characteristics of the engine, such as fuel consumption and engine accelerability.

The CPU 5*b* outputs signals for driving the fuel injection valves 6, based on results of the above calculation, via the output circuit 5*d*.

As can be understood from the above equation (1), the fuel injection period Tout of each fuel injection valve 6 is influenced by the value of the air-fuel ratio correction coefficient KLAF×the evaporative fuel-dependent correction coefficient KEVAP.

Accordingly, when the fuel injection period Tout is being corrected by the air-fuel ratio correction coefficient KLAF which is calculated based on the difference between the desired air-fuel ratio coefficient KCMD and the actual air-fuel ratio KACT and feedback control gains (KP, KI, KD), as described hereinafter, if the evaporative fuel-dependent correction coefficient KEVAP becomes smaller to compensate for the influence of purging, the controlled air-fuel ratio can undergo hunting or diverge if the feedback control gains are large.

To overcome this inconvenience, according to the present embodiment, when the influence of purging is large and hence the evaporative fuel-dependent correction coefficient KEVAP is small, the rate of change in the air-fuel ratio correction coefficient KLAF is set to a smaller value, to thereby prevent hunting of the controlled air-fuel ratio during execution of the feedback control.

Figure 2:
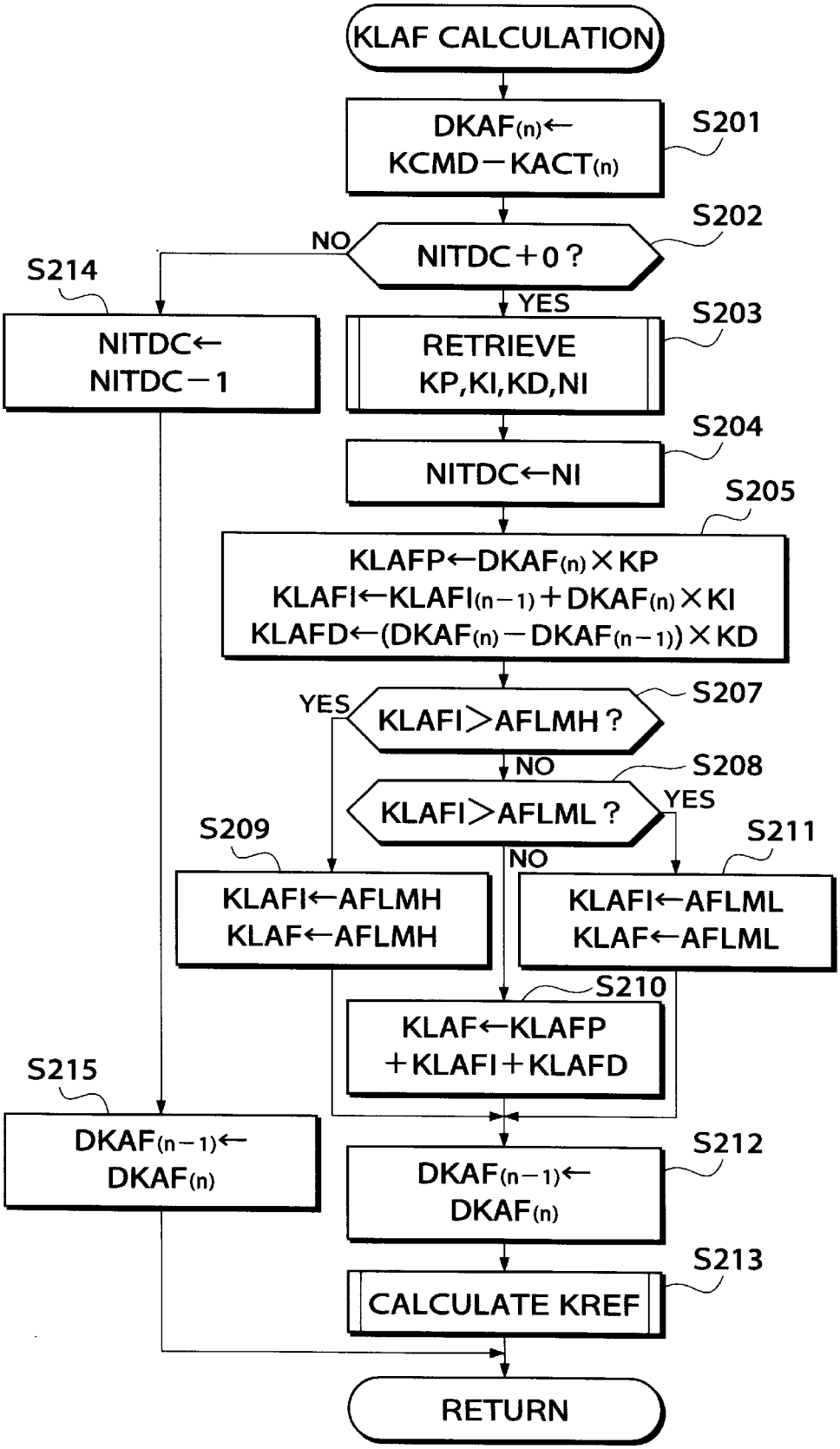
FIG. 2 is a flowchart showing a routine for calculating an air-fuel ratio correction coefficient KLAF.

FIG. 2 shows a routine for calculating the air-fuel ratio correction coefficient KLAF, which is executed in synchronism with generation of TDC signal pulses.

First, at a step S201, a present value KACT(n) of the actual air-fuel ratio KACT is subtracted from the desired air-fuel ratio coefficient KCMD to calculate a present value DKAF(n) of the difference between the KCMD value and the KACT(n) value.

Then, it is determined at a step S202 whether or not a KLAF updating-thinning variable NITDC which is set to a predetermined value NI at a step S204, referred to hereinbelow, assumes 0. The KLAF updating-thinning variable NITDC is for updating the air-fuel ratio correction coefficient KLAF whenever TDC signal pulses are generated in a number set according to operating conditions of the engine. If NITDC=0 holds, the program proceeds to a step S203 et seq. to update the KLAF value.

At the step S203, the feedback control gains, i.e. a proportional term (P term) KP, an integral term (I term) KI, and a differential term (D term) KD are retrieved from a table shown in FIG. 3, and the predetermined value NI of the KLAF updating-thinning variable NITDC is determined from an NI table, not shown. The table of FIG. 3 is for setting the feedback control gains according to the set desired air-fuel ratio (KCMD) and the evaporative fuel-dependent correction coefficient KEVAP. This table is provided for each of the control terms KP, KI and KD.

As is apparent from the FIG. 3 table, when the desired air-fuel ratio (KCMD) is set to a stoichiometric value ($\lambda$=1), if the influence of evaporative fuel is small and accordingly the KEVAP value is large, the feedback control gain (KP, KI, KD) is set to a large value, while if the influence of evaporative fuel is large and accordingly the KEVAP value is small, the feedback control gain is set to a small value. Further, when the desired air-fuel ratio is set to a value other than the stoichiometric value (leaner than the stoichiometric value or a richer value than the same (WOT)), if the influence of evaporative fuel is small and accordingly the KEVAP value is large, the feedback control gain is set to a medium value, while if the influence of evaporative fuel is large and accordingly the KEVAP value is small, the feedback control gain is set to a small value. Alternatively, when the desired air-fuel ratio coefficient KCMD is set to a value other than the stoichiometric value and the KEVAP value is large, the feedback control gain may be set to a large value. The evaporative fuel-dependent correction coefficient KEVAP is determined by a subroutine of FIG. 4, described hereinafter.

Referring again to FIG. 2, at the step S204, the KLAF updating-thinning variable NITDC is set to the predetermined value NI determined at the step S203, and then at a step S205, a P-term air-fuel ratio correction coefficient KLAFP, an I-term air-fuel ratio correction coefficient KLAFI, and a D-term air-fuel ratio correction coefficient KLAFD for calculation of the air-fuel ratio correction coefficient KLAF are calculated by the use of the following respective equations (2) to (4):

$$KLAFP=DKAF(n)\times KP \tag{2}$$

$$KLAFI=KLAFI(n-1)+DKAF(n)\times KI \tag{3}$$

$$KLAFD=(DKAF(n)-DKAF(n-1))\times KD \tag{4}$$

Then, the KLAF value, etc. are limit-checked, and then the KLAF value is finally determined at a step S207 et seq.

At the step S207, it is determined whether or not the KLAFI value is larger than an air-fuel ratio upper limit value AFLMH, and it is determined at a step S208 whether or not the KLAFI value is smaller than an air-fuel ratio lower limit value AFLML. From the above determinations, if KLAFI>AFLMH holds, the KLAFI value as well as the KLAF value are set to the upper limit value AFLMH at a step S209. If AFLMH≧KLAFI>AFLML holds, the KLAF value is set to the sum of the KLAFP, KLAFI and KLAFD values at a step S210. If KLAFI<AFLML holds, the KLAFI value as well as the KLAF value are set to the AFLML value at a step S211, followed by the program proceeding to a step S212.

At the step S212, a last value DKAF(n−1) of the difference between the KCMD value and the KACT(n−1) value is set to the present difference value DKAF(n), and a learned value KREF of the KLAF value is calculated at a step S213, by the use of the following equation (5), followed by terminating the present routine:

$$KREF=c\times KLAFI+(1+c)\times KREF(n-1) \tag{5}$$

where c represents a constant set to a value between 0 and 1.0.

On the other hand, if NITDC≠0 holds at the step S202, the NITDC value is decremented by 1 at a step S214, and then the last difference value DKAF(n−1) is set to the present difference value DKAF(n) at a step S215, followed by terminating the present routine.

FIG. 4 shows a routine for determining the evaporative fuel-dependent correction coefficient KEVAP, which is executed in synchronism with generation of TDC signal pulses.

First, at a step S401, it is determined whether or not the engine is in starting mode. If the engine is not in the starting mode, the program proceeds to a step S402, wherein it is determined whether or not purging is being carried out. If purging is being carried out, the program proceeds to a step S403, wherein it is determined whether or not a valve-opening duty ratio DFR of the purge control valve 22 is larger than a predetermined value DFREV. IF DFR>DFREV holds, which means that the amount of purging of evaporative fuel exceeds a predetermined value, the program proceeds to a step S404, wherein it is determined whether or not the air-fuel ratio feedback control responsive to the output from the LAF sensor 15 (LAF feedback control) is being carried out.

If the LAF feedback control is being carried out, the program proceeds to a step S405, wherein it is determined whether or not the KEVAP value exceeds a predetermined value KEVADD. If KEVAP>KEVADD holds at the step S405, the count value of a KEVAP correction delay timer tmEVADD is set to 0 at a step S406, followed by the program proceeding to a step S408. On the other hand, if KEVAP≦KEVADD holds, the timer tmEVADD is set to a predetermined time period TEVADD at a step S407, followed by the program proceeding to the step S408.

Figure 5:
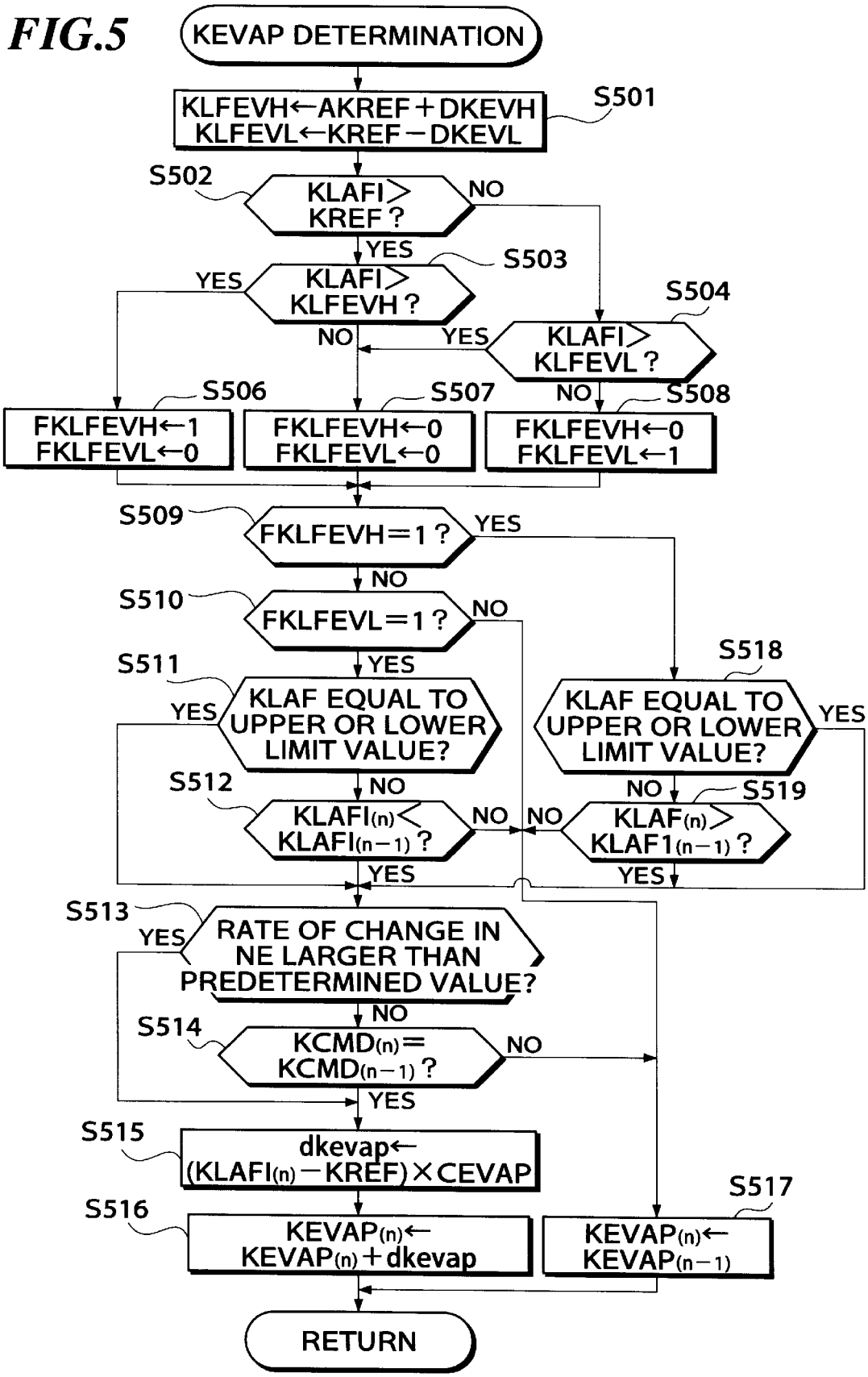
FIG. 5 is a flowchart showing a subroutine for calculating the KEVAP value, which is executed at a step S408 in FIG. 4.

At the step S408, the evaporative fuel-dependent correction coefficient KEVAP is calculated by a subroutine of FIG. 5, hereinafter described, and then a weighted average value KEVREFI of the KEVAP value is calculated at a step S409, by the use of the following equation (6):

$$KEVREFI(n)=c\times KEVAP(n)+(1-c)\times KEVREFI(n-1) \quad (6)$$

where c represents a constant set to a value between 0 and 1.0.

Figure 6:
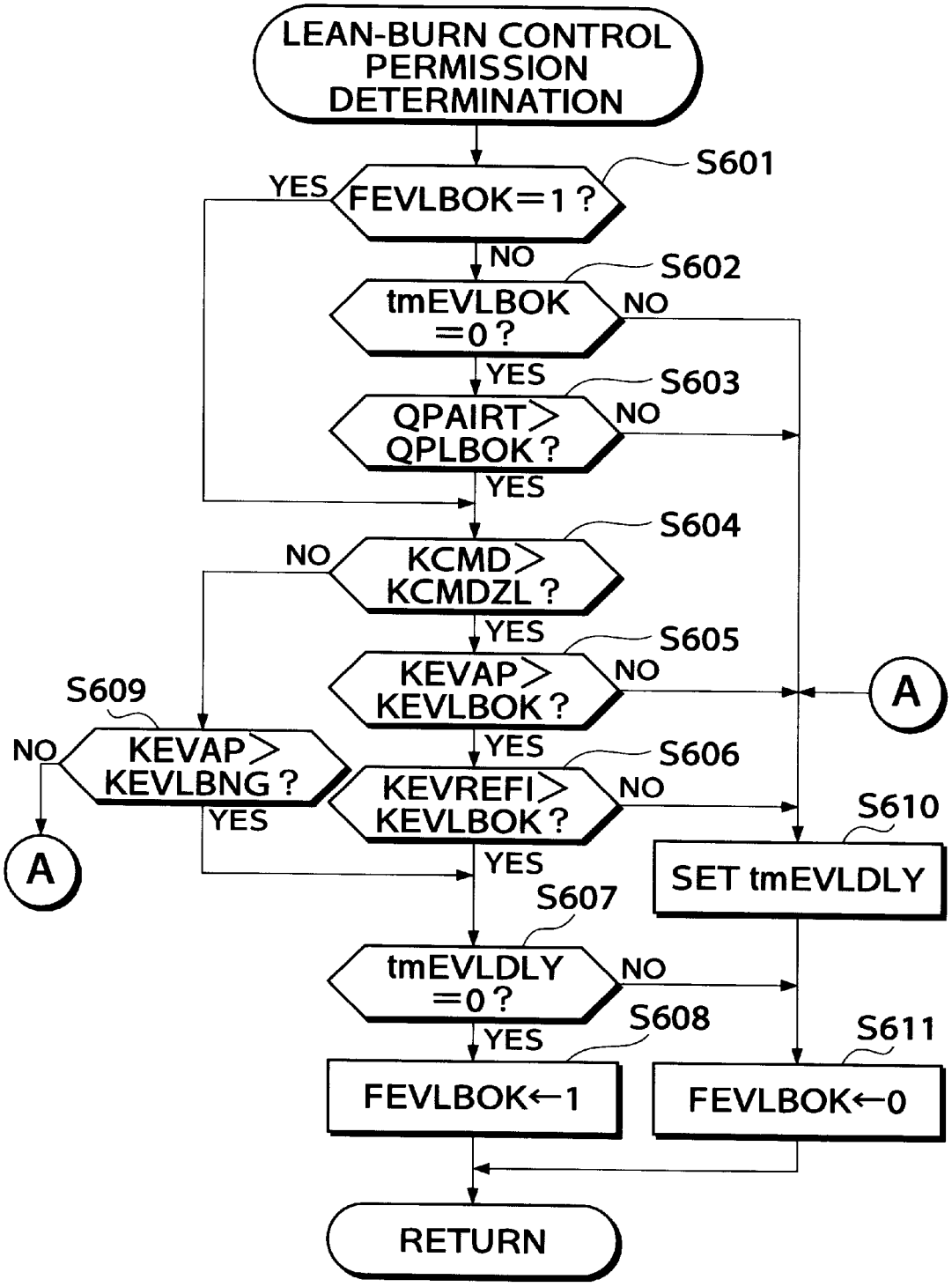
FIG. 6 is a flowchart showing a subroutine for carrying out a lean-burn permission-determining process, which is executed at a step S410 in FIG. 4.

Then, at a step S410, a determination as to lean-burn control permission is carried out by a subroutine of FIG. 6, described hereinafter, and then a limit-checking of the evaporative fuel-dependent correction coefficient KEVAP is carried out at a step S411, followed by terminating the present routine.

On the other hand, if purging is not being carried out at the step S402, if DFR≦DFREV holds at the step S403, or if the LAF feedback control is not being carried out at the step S404, the program proceeds to a step S412, wherein a rich-side LAP feedback control flag FKLFEVH is set to "0" and at the same time a lean-side LAF feedback control flag FKLFEVL is set to "0". The rich-side LAF feedback control flag FKLFEVH, when set to "1", indicates that the LAF feedback control is to be carried out to control the air-fuel ratio to a richer value than the stoichiometric air-fuel ratio, while the lean-side LAF feedback control flag FKLFEVL, when set to "1", indicates that the LAP feedback control is to be carried out to control the air-fuel ratio to a leaner value than the stoichiometric air-fuel ratio. Then, the program proceeds to a step S414.

At the step S414, it is determined whether or not the count value of the timer tmEVADD is equal to 0. If the predetermined time period TEVADD has elapsed and accordingly the count value of the timer tmEVADD is equal to 0, the program proceeds to a step S415, wherein a calculation is made of a value of (1−KEVAP(n−1))×CEVADD, and a result of the calculation is set as a value dkevadd. The value dkevadd is an addend for calculating the present value KEVAP(n) of the evaporative fuel-dependent correction coefficient KEVAP to be used at a step S416, and the value CEVADD represents a coefficient for calculating the value dkevadd.

Then, a value of KEVAP(n−1)+dkevadd is calculated to obtain the KEVAP(n) value at the step S416, and then a lean-burn permission-determining delay timer tmEVLBOK is set to a predetermined time period TEVLBOK at a step S417, followed by the program proceeding to the step S411.

If tmEVADD≠0 holds at the step S414, the present value KEVAP(n) of the evaporative fuel-dependent correction coefficient KEVAP is set to the last value KEVAP(n−1) thereof at a step S418, followed by the program proceeding to the step S417.

On the other hand, if the engine is in the starting mode at the step S401, the evaporative fuel-dependent correction coefficient KEVAP is set to 1.0 at a step S419, and a learned value KEVAPREF thereof is set to 1.0 at a step S420, followed by terminating the routine.

Next, description will be made of a manner of calculation of the evaporative fuel-dependent correction coefficient KEVAP with reference to FIG. 5 which shows a subroutine executed at the step S408 in FIG. 4.

First, at a step S501, a value of KREF+DKEVH is calculated by adding a predetermined value DKEVH to the learned value KREF of the KLAF value calculated at the step S213 in FIG. 2, to set the resulting sum as an upper threshold value KLFEVH of the KLAF value. At the same time, a value of KREF−DKEVL is calculated by subtracting a predetermined value DKEVL from the learned value KREF, to set the resulting difference as a lower threshold value KLFEVL of the KLAF value. DKEVH represents an addend for calculating the upper threshold value KLFEVH, while DKEVL represents a subtrahend for calculating the lower threshold value KLFEVL.

Then, it is determined at a step S502 whether or not the I-term air-fuel ratio correction coefficient KLAFI exceeds the learned value KREF, then it is determined at a step S503 whether or not the KLAFI value exceeds the upper threshold value KLFEVH, and it is determined at a step S504 whether or not the KLAFI value exceeds the lower threshold value KLFEVL. From results of the above determinations, if KLAFI>KLFEVH holds, the rich-side LAF feedback control flag FKLFEVH is set to "1" and at the same time the lean-side LAF feedback control flag FKLFEVL is set to "0" at a step S506, followed by the program proceeding to a step S509. If KLFEVH≧KLAFI>KLFEVL holds, the flag FKLFEVH is set to "0" and at the same time the flag FKLFEVL is set to "0" at a step S507, followed by the program proceeding to the step S509. Further, if KLAFI≦KLFEVL holds, the flag FKLFEVH is set to "0" and at the same time the lean-side LAF feedback control flag FKLFEVL is set to "1" at a step S508, followed by the program proceeding to the step S509.

At the step S509, it is determined whether or not the rich-side LAF feedback control flag FKLFEVH is set to "1", and then it is determined at a step S510 whether or not the lean-side LAF feedback control flag FKLFEVL is set to "1".

From results of the determinations if the flag FKLFEVH is set to "0" and at the same time the flag FKLFEVL is set to "1", which means that the LAF feedback control is being executed to control the air-fuel ratio to a leaner value than the stoichiometric air-fuel ratio, steps S511 to S516 are executed.

That is, it is determined at the step S511 whether or not the KLAF value is equal to an upper or a lower limit value thereof, and if the KLAF value is not equal to the lower limit value, it is determined at the step S512 whether or not the KLAFI(n) value is below the KLAFI(n−1) value.

If the KLAF value is equal to its upper or lower limit value at the step S511, or if KLAFI(n)<KLAFI(n−1) holds at the step S512, the program proceeds to the step S513, wherein it is determined whether or not a rate of change in the engine rotational speed NE is larger than a predetermined value and hence the KCMD value should be corrected. If the KCMD value need not be corrected, the program proceeds to the step S514, wherein it is determined whether or not a present value KCMD(n) of the desired air-fuel ratio coefficient KCMD is equal to a last value KCMD(n−1) thereof.

If the KCMD value should be corrected at the step S513 or if KCMD(n)=KCMD(n−1) holds at the step S514, the program proceeds to the step S515, wherein a value of (KLAFI(n)−KREF)×CEVAP is calculated, to set the calculated value as a value dkevap. The dkevap value is an addend for calculating the present evaporative fuel-dependent correction coefficient value KEVAP(n) to be used at a step S516, and CEVAP represents a coefficient for calculating the addend dkevap. Next, a value of KEVAP(n−1)+dkevap is calculated to obtain the present evaporative fuel-dependent correction coefficient value KEVAP(n) at the step S516, followed by terminating the present routine.

On the other hand, from results of the determinations of the steps S509 and S510, if the flag FKLFEVH is set to "0" and at the same time the flag FKLFEVL is set to "0", which means that the LAF feedback control is being executed to control the air-fuel ratio to the stoichiometric air-fuel ratio, the program proceeds to a step S517, wherein the present value KEVAP(n) of the evaporative fuel-dependent correction coefficient KEVAP is set to the last value KEVAP(n−1) thereof, followed by terminating the present routine. Further, if KLAF(n)≧KLAF(n−1) holds at the step S512, or if KCMD(n)≠KCMD(n−1) holds at the step S514, the program proceeds to the step S517, wherein the KEVAP(n) value is set to the KEVAP(n−1) value, followed by terminating the present routine.

On the other hand, from a result of the determination of the step S509, if the flag FKLFEVH is set to "1" and at the same time the flag FKLFEVL is set to "0", which means that the LAF feedback control is being executed to control the air-fuel ratio to a richer value than the stoichiometric air-fuel ratio, the program proceeds to a step S518, wherein it is determined whether or not the KLAF value is equal to an upper or lower limit value thereof. If the KLAF value is not equal to the upper or lower limit value, the program proceeds to a step S519, wherein it is determined whether or not the KLAFI(n) value exceeds the KLAFI(n−1) value. If KLAFI(n)≦KLAFI(n−1) holds, the program proceeds to the step S517, followed by terminating the present routine.

If the KLAF value is equal to the upper or lower limit value thereof at the step S518, or if KLAFI(n)>KLAFI(n−1) holds at the step S519, the program proceeds to the step S513, and then the steps S513 to S516 are executed, followed by terminating the present routine.

Next, description will be made of a lean-burn control permission-determining process with reference to FIG. 6, which is executed at the step S410 in FIG. 4.

First, at a step S601, it is determined whether or not a lean-burn control permission flag FEVLBOK which, when set to "1", indicates that lean-burn control is permitted, assumes "1". If the lean-burn control permission flag FEVLBOK assumes "0", then it is determined at a step S602 whether or not the count value of the lean-burn control permission-determining delay timer tmEVLBOK is equal to "0".

If the count value of the timer tmEVLBOK is equal to 0 at the step S602, which means that the predetermined time period TEVLBOK has elapsed, and then it is determined at a step S603 whether or not an integrated purging amount QPAIRT which is the total amount of evaporative fuel purged after the start of the engine exceeds a predetermined value QPLBOK.

If the integrated purging amount QPAIRT exceeds the predetermined value QPLBOK, which means the purging amount is large, the program proceeds to a step S604, wherein it is determined whether or not the desired air-fuel ratio coefficient KCMD exceeds a predetermined value KCMDZL. On the other hand, if the lean-burn control permission flag FEVLBOK assumes "1" at the step S601, the program jumps over the steps S602 and S603 to the step S604.

If KCMD>KCMDZL holds at the step S604, it is determined at a step S605 whether or not the KEVAP value exceeds a lean-burn control permission-determining value KEVLBOK. If KEVAP>KEVLBOK holds, which means that the influence of purging is small, the program proceeds to a step S606, wherein it is determined whether or not the weighted average value KEVREFI of the evaporative fuel-dependent correction coefficient KEVAP exceeds the lean-burn control permission-determining value KEVLBOK.

If KEVREFI>KEVLBOK holds at the step S606, which means that the influence of purging is small, the program proceeds to a step S607, wherein it is determined whether or not the count value of a timer tmEVLDLY is equal to 0. If the count value of the timer tmEVLDLY is equal to 0, which means that a predetermined time period TEVLDLY has elapsed, the flag FEVLBOK is set to "1" at a step S608, followed by terminating the present routine.

If KCMD≦KCMDZL holds at the step S604, which means that the lean-burn control is being carried out, the program proceeds to a step S609, wherein it is determined whether or not the KEVAP value exceeds a lean-burn control inhibition-determining value KEVLBNG. If KEVAP>KEVLBNG holds at the step S609, which means that the influence of purging is small, the steps S607 and S608 are executed. On the other hand, if KEVAP≦KEVLBNG holds, which means that the influence of purging is large, and then the program proceeds to a step S610. At the step S610, the timer tmEVLDLY is set to the predetermined value TEVLDLY, and the flag FEVLBOK is set to "0" at a step S611, followed by terminating the present routine.

On the other hand, if tmEVLBOK≠0 holds at the step S602, if QPAIRT≦QPLBOK holds at the step S603, i.e. if the integrated purging amount is small, if KEVAP≦KEVLBK holds at the step S605, i.e. if the influence of purging is large, or if KEVAP≦KEVLBOK holds at the step S606, i.e. if the influence of purging is large, the program proceeds to the step S610, wherein the timer tmEVLDLY is set to the predetermined time period TEVLDLY, and then the step S611 is executed, followed by terminating the present routine.

If the count value of the timer tmEVLDLY is not equal to 0 at the step S607, which means that the predetermined time period TEVLDLY has not elapsed, the program proceeds to the step S611, wherein the flag FEVLOBOK is set to "0", followed by terminating the present routine.

Figure 7:
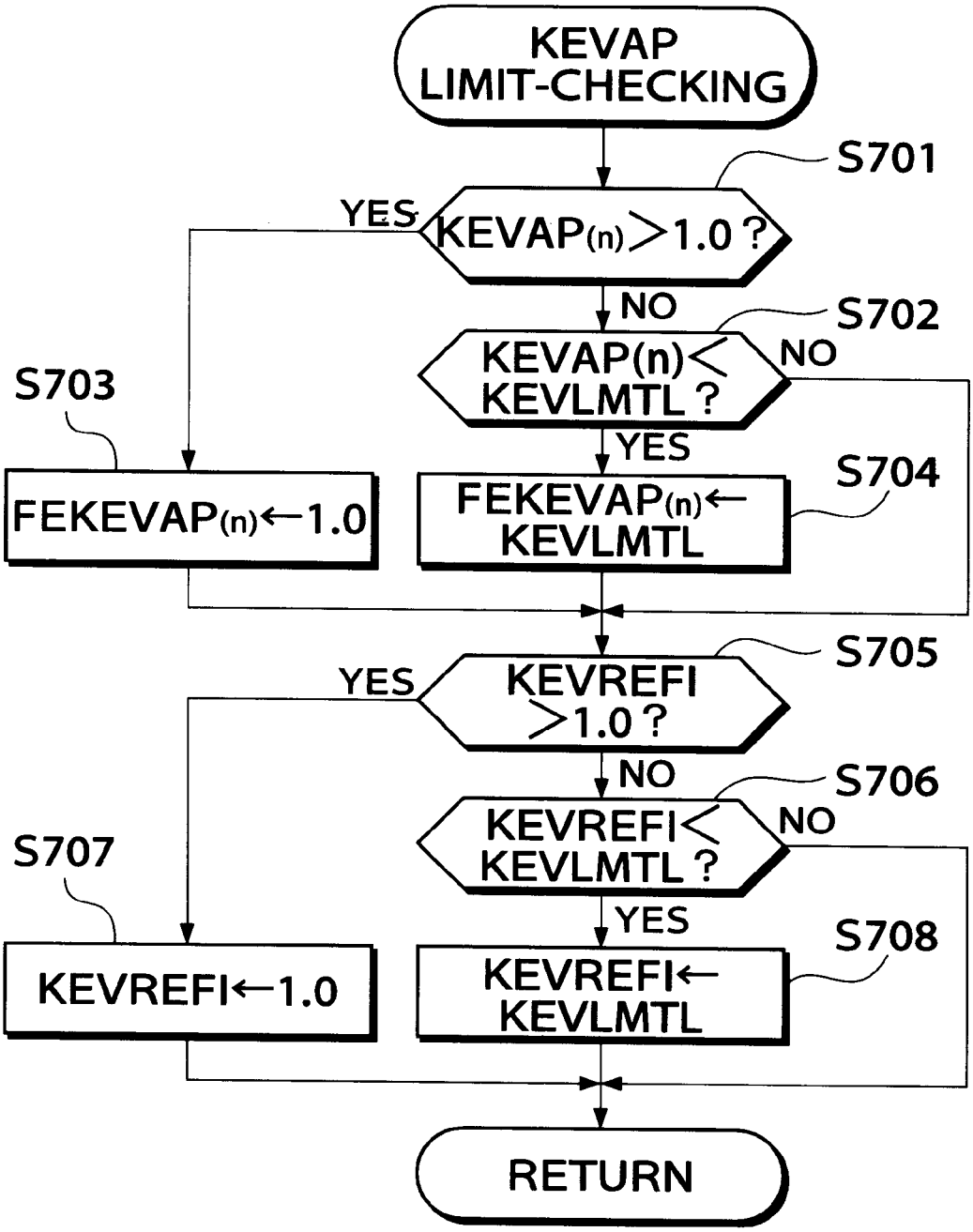
FIG. 7 is a flowchart showing a subroutine for carrying out a limit-checking of the KEVAP value, which is executed at a step S411 in FIG. 4.

FIG. 7 shows a subroutine for carrying out the limit-checking of the evaporative fuel-dependent correction coefficient KEVAP, which is executed at the step S611 in FIG. 4.

First, at a step S701, it is determined whether or not the KEVAP(n) value exceeds 1.0, and then it is determined at a step S702 whether or not the KEVAP(n) value is below a lower limit value KEVLMTL thereof. From results of the determinations, if KEVAP(n)>1.0 holds, the KEVAP(n) value is set to 1.0 at a step S703. If 1.0≧KEVAP(n)

≧KEVLMTL holds, the KEVAP(n) value is held as it is. On the other hand, if KEVAP(n)<KEVLMTL holds, the KEVAP (n) value is set to the KEVLMTL value at a step S704.

Then, it is determined at a step S705 whether or not the weighted average value KEVREFI exceeds 1.0, and it is determined at a step S706 whether or not the KEVREFI value is below the lower limit value KEVLML. From results of the determinations, if KEVREFI>1.0 holds, the KEVREFI value is set to 1.0 at a step S707. If 1.0≧KEVREFI≧KEVLMTL holds, the KEVREFI value is held as it is. If KEVREFI<KEVLMTL holds, the KEVREFI value is set to the KEVLMTL value at the step S708. The KEVLMTL value is calculated by a background process of FIG. 8, referred to hereinbelow, which is executed at predetermined time intervals.

Figure 8:
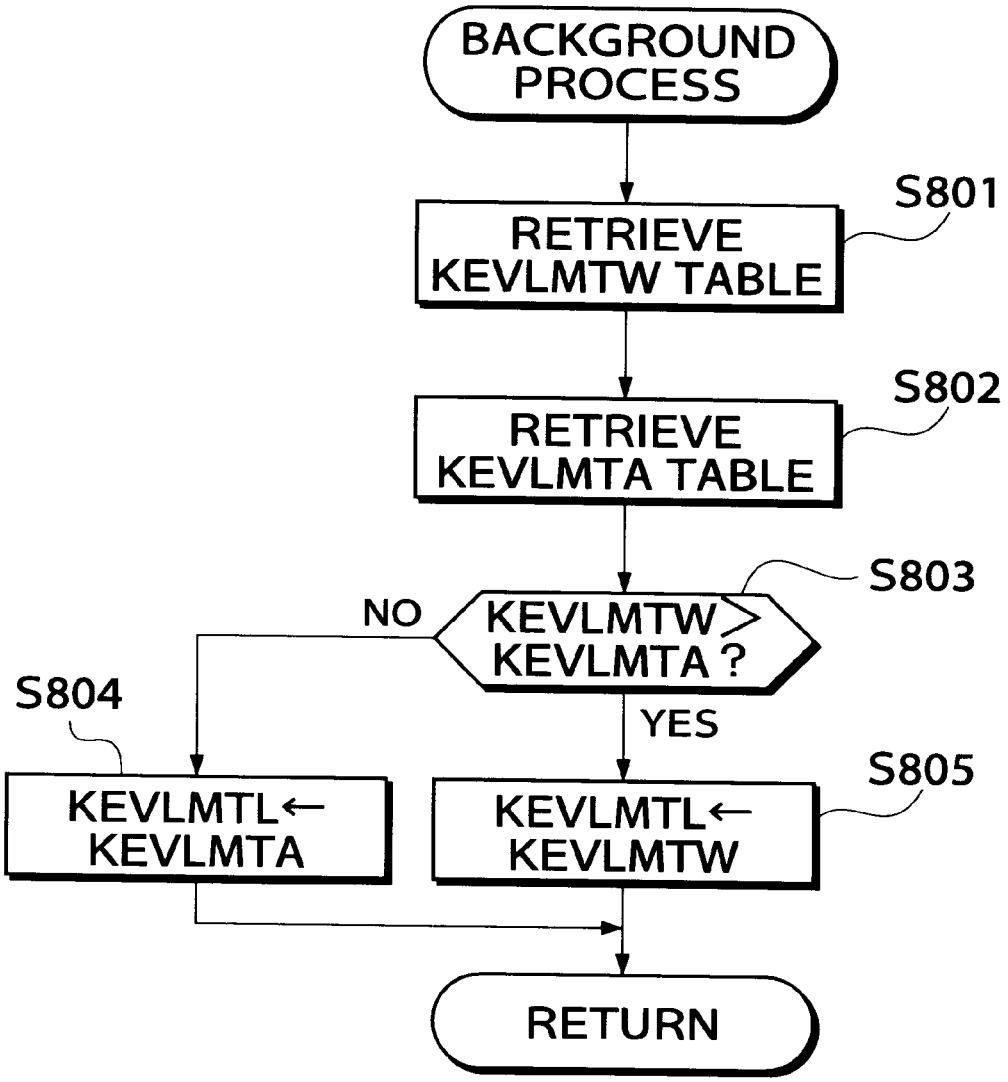
FIG. 8 is a flowchart showing a subroutine for determining a lower limit value KEVLMTL of the correction coefficient KEVAP.

First, at a step S801 in FIG. 8, an evaporative fuel-dependent correction coefficient limit value KEVLMTW is determined from a KEVLMTW map, not shown, according to the engine coolant temperature TW. The KEVLMTW map is set such that the KEVLMTW value is smaller as the engine coolant temperature TW becomes higher. Then, at a step S802, an evaporative fuel-dependent correction coefficient limit value KEVLMTA is determined from a KEVLMTA map, not shown, according to the intake air temperature TA. The KEVLMTA map is set such that the KEVLMTA value is smaller as the intake air temperature TA becomes higher.

Then, it is determined at a step S803 whether or not the KEVLMTW value exceeds the KEVLMTA value. If KEVLMTW>KEVLMTA holds, the KEVLMTL value is set to the KEVLMTW value at a step S805, whereas if KEVLMTW≦KEVLMTA holds, the KEVLMTL value is set to the KEVLMTA value at a step S804, followed by terminating the present routine.

According to the present embodiment, when the evaporative fuel-dependent correction coefficient KEVAP calculated by the process of FIG. 4 is small and accordingly the influence of purging is large, the rate of change in the air-fuel ratio correction coefficient KLAF calculated by the process of FIG. 2 is set to a smaller value (see FIG. 2, step S203 and FIG. 3). As a result, hunting of the controlled air-fuel ratio during the air-fuel ratio feedback control can be prevented.

What is claimed is:

1. In an air-fuel ratio control system for an internal combustion engine having an exhaust system and a fuel tank, including air-fuel ratio-detecting means arranged in said exhaust system, for generating an output indicative of an air-fuel ratio of exhaust gases emitted from said engine, feedback control means for carrying out feedback control of controlling an air-fuel ratio of a mixture supplied to said engine to a predetermined desired air-fuel ratio in response to said output from said air-fuel ratio-detecting means, by using at least one feedback control gain, and purge control means for purging evaporative fuel generated in said fuel tank to said engine, the improvement wherein:

said feedback control means sets said at least one feedback control gain to a smaller value when a degree of influence of evaporative fuel purged by said purge control means upon said air-fuel ratio of said mixture is larger, and sets said at least one feedback control gain to a larger value when said degree of influence of said purged evaporative fuel upon said air-fuel ratio of said mixture is smaller.

2. An air-fuel ratio control system as claimed in claim 1, wherein said air-fuel ratio-detecting means has an output characteristic almost proportional to said air-fuel ratio of said exhaust gases.

3. An air-fuel ratio control system as claimed in claim 1, wherein said feedback control means sets said at least one feedback control gain in dependence on said predetermined desired air-fuel ratio and said degree of influence of said purged evaporative fuel upon said air-fuel ratio of said mixture.

4. An air-fuel ratio control system as claimed in claim 3, wherein said feedback control means sets said at least one feedback control gain to a smaller value when said predetermined desired air-fuel ratio is equal to a stoichiometric air-fuel ratio and at the same time said degree of influence of said purged evaporative fuel upon said air-fuel ratio of said mixture is larger.

5. An air-fuel ratio control system as claimed in claim 1, wherein said feedback control means calculates an air-fuel ratio correction value based on a difference between said output from said air-fuel ratio-detecting means and said predetermined desired air-fuel ratio and said at least one feedback control gain, and corrects a feedback control amount for use in said feedback control by using said air-fuel ratio correction value.

6. An air-fuel ratio control system as claimed in claim 5, wherein said feedback control means sets an evaporative fuel-dependent correction value in dependence on said degree of influence of said purged evaporative fuel upon said air-fuel ratio of said mixture, and corrects said feedback control amount by using said evaporative fuel-dependent correction value together with said air-fuel ratio correction value.

7. An air-fuel ratio control system as claimed in claim 6, wherein said feedback control means calculates said evaporative fuel-dependent correction value, based on said air-fuel ratio correction value.

* * * * *